US009532654B1

(12) United States Patent
Adams, IV et al.

(10) Patent No.: US 9,532,654 B1
(45) Date of Patent: Jan. 3, 2017

(54) CHAIR HAVING RETRACTABLE CUP HOLDER

(71) Applicant: Adams Mfg. Corp., Portersville, PA (US)

(72) Inventors: William E. Adams, IV, Harmony, PA (US); Matthew Goodworth, Pittsburgh, PA (US); Kevin A. Harper, Mason, OH (US); Shlomo Snir, Cranberry Township, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 15/083,762

(22) Filed: Mar. 29, 2016

(51) Int. Cl.
*A47C 7/68* (2006.01)
*A47C 5/12* (2006.01)

(52) U.S. Cl.
CPC .. *A47C 7/68* (2013.01); *A47C 5/12* (2013.01)

(58) Field of Classification Search
CPC ..... A47C 7/68; A47C 5/12
USPC ..... 297/145, 188.14, 188.16, 188.17
See application file for complete search history.

(56) References Cited

U.S. PATENT DOCUMENTS 2,430,682 A * 11/1947 Merkle ..... A47B 13/16 108/25
4,474,354 A 10/1984 Field
5,060,899 A * 10/1991 Lorence ..... B60N 3/102 224/401
5,745,565 A 4/1998 Wakefield
5,791,616 A * 8/1998 Volkmann ..... B60N 3/106 224/926
6,361,105 B1 * 3/2002 Turner ..... A47C 7/62 297/16.2
7,036,784 B2 5/2006 Peitzmeier et al.
(Continued)

FOREIGN PATENT DOCUMENTS

DE 202004021532 11/2008

OTHER PUBLICATIONS

Gracious Living Cup Holder for Adirondack Chairs; https://www.lowes.ca/1/1/287639-cup-holder-adirondack-chairs, dated Mar. 11, 2016.

*Primary Examiner* — Milton Nelson, Jr.
(74) *Attorney, Agent, or Firm* — Buchanan Ingersoll & Rooney PC

(57) ABSTRACT

A stackable molded plastic chair has a cup holder is connected to a cylindrical boss on the underside of a chair arm for movement between a retracted position lying underneath the chair arm and an open position extending away from the arm of the chair. The cup holder has a tubular boss having a first portion extending from the top surface of the cup holder and a second portion extending from the bottom surface of the cup holder. The first portion is at least partially within the cylindrical boss on the chair arm. A pin within the tubular boss has two or more spaced apart legs each leg having a foot. As the pin is inserted into the tubular boss the legs will move inward and then will move outward when the feet reach a recess on the inside surface of the cylindrical boss on the chair arm. The feet are each sized and configured to fit into the recess and the legs preferably have an outward curvature. The use of multiple legs having an outward curvature allows the pin to pop free when an excessive force is applied to the cup holder releasing the cup holder from the chair arm without breaking either the cup holder or the chair arm.

20 Claims, 11 Drawing Sheets

(56) References Cited

U.S. PATENT DOCUMENTS

| | | | | |
|---|---|---|---|---|
| RE39,392 | E | 11/2006 | Bergin | |
| D546,823 | S | 7/2007 | Dayan | |
| 7,530,632 | B2 | 5/2009 | Kaloustian et al. | |
| 8,182,031 | B1 | 5/2012 | MacKenzie | |
| 8,636,319 | B1 | 1/2014 | Parker, Jr. | |
| 2006/0061155 | A1 | 3/2006 | Steenson | |
| 2011/0121619 | A1 | 5/2011 | Chappell | |
| 2011/0266843 | A1* | 11/2011 | Gamboa | A47C 3/04 297/188.14 |
| 2016/0121768 | A1* | 5/2016 | Terranova | B60N 2/4673 297/188.14 |

* cited by examiner

CHAIR HAVING RETRACTABLE CUP HOLDER

FIELD OF INVENTION

The invention relates to chairs having a cup holder on one or both arms of the chair.

BACKGROUND OF THE INVENTION

One type of chair, popular for use as outdoor furniture, is a molded plastic chair. These chairs are a single molded structure and are usually configured so that one chair may be stacked on another chair. Stackable chairs have an advantage in that they can be stacked upon one another and placed on a pallet for easy transport. A retailer may display the stacked chairs on the same pallet on which they have been shipped. Consumers may also store several stackable chairs stacked one upon another.

There are many types of chairs which have cup holders on one or both arms of the chair. One type of cup holder consists of a circular opening in the top surface of the arm of the chair which is sized to receive a cup or other beverage container. The opening may be tapered to hold the cup with a friction fit or there may be a cup-shaped structure below the opening which holds the cup or beverage container. Significant disadvantages of this type of cup holder are that resting one's arm on a chair arm having an opening can be uncomfortable, one's hand may slip and twist into the opening while pushing off from the arm to get up, and any beverage container placed in the opening becomes an impediment to the use of the arm while sitting in or while trying to get out of the chair. Additionally, the opening in the chair arm detracts from the appearance of the chair and objects can fall through or become stuck in the opening.

Another type of cup holder is mounted on and extends outward from the chair arm. Some such cup holders are attached to the arm by straps or clamps and are removable from the chair arm when not in use. Example of this type of cup holder can be found in Published United States Patent Application No. 2006/0061155 A1. This type of holder may be cumbersome to attach and detach. The cup holder may never fit snugly and securely and thus during use the cup holder may slip or fall off from the weight of beverages or from being bumped. If this type of cup holder is stored separately from the chair, the cup holder can easily be misplaced or lost. Of course, this problem can be overcome by permanently attaching the cup holder to the chair arm. But cup holders, especially ones held on by straps or clamps, are not usually aesthetically pleasing and it would be preferable that the cup holder not be visible except when in use. Also, permanently attached cup holders and their connection mechanisms will be prone to collecting dirt and also more difficult to clean. Next, permanently attached cup holders may interfere with people walking by the chair, prevent similar chars from being placed close together side by side, and prevent, or cause uneven, stacking of chairs. Finally, chairs with permanent holders take up more space in storage and, if attached at the factory, permanent cup holders would likely dramatically reduce the number of chairs that would fit on a tractor trailer, thereby increasing shipping costs.

Yet, another type of cup holder is attached to the underside of a chair arm or to the arm support and can pivot or rotate between a closed position in which the cup holder is nested under the arm of the chair for storage and an extended position for use. U.S. Pat. Nos. 6,361,105 B1 and 8,182,031 B2 disclose this type of cup holder. While this type of cup holder does not have many of the problems of the other cup holders described above, there are still serious issues that include:

1) A lack of structure whereby the cup holder itself is not sufficiently robust. This type of cup holder is essentially a cantilever beam with a fixed end and a floating or free end. As such, loads or forces that are applied to the cup holder are magnified towards the fixed end. This is because the moment increases towards the fixed end of a cantilever beam. So, when beverages are placed in the cup holder, it may sag unacceptably due to a lack of structure especially near the fixed end where the forces are greater. Also, cup holders that swing out to the side of the arm are put into a highly exposed position where at times they may get sat on or pushed down on or otherwise experience some manner of excessive loading or abuse. For any given chair, it may not happen frequently or may never happen, but some form of accidental excessing loading may happen one or more times to a significant number of chairs. This type of cup holder may crack if it is subjected to just one occurrence of excessive loading.
2) Bolts or screws that are feasible for use in attaching the cup holder will likely not provide adequate purchase because their diameter is simply not large enough to create sufficient grip between the threads and the plastic pilot hole. Moving to a bolt or screw with a large enough diameter to achieve sufficient purchase may be cost prohibitive or create other problems such as large diameter bolts or screws might distort the boss they are being driven into such that the whole system would bind up and the cup holder would not be able to rotate. Bolts or screws of a diameter feasible to use may tear out during normal usage or instances of inadvertent higher-than-normal pressures on the cup holder, such as if someone accidentally pushed down on the cup holder when getting out of the chair. If the bolt or screw were torn out, even just once, this would likely strip the pilot hole into which the bolt or screw was driven. Once the pilot hole for the boss or screw has been stripped out, there would either be no way to reaffix the cup holder to the chair, or, if it could be reaffixed, the gripping strength of the bolt or screw may be so compromised that the cup holder may no longer be able to function without frequently coming loose and falling off of the chair. It is worth noting that with this type of cup holder, torque is created when the cup holder is loaded and this torque acts directly on the bolt or screw. As a result any loading on the cup holder will be concentrated on the portion of the threads facing towards the loading. This concentration of loading exacerbates the deficiency of bolts or screws as a way to attach this type of cup holder.
3) Cup holders of this type do not have a break-away mechanism. We have discussed how, during excessive loading, it is possible that the cup holder could fail, or that the bolt/screw connecting the cup holder to the chair could fail. A third possibility is that the chair or chair arm would fail. Severe cracking may occur, severe enough where the chair damage would be very conspicuous. In which case the chair should and would often be discarded. This means the whole chair would be lost due to an issue with just the cup holder. Or there could be less severe cracking, whereby the damage either went unnoticed or was deemed not severe enough to scrap the chair over. In either event, the chair might remain in service and the chair or chair arm might fail during continued use and potentially injure someone.

4) When desiring the cup holder to stay in the retracted position, it may not oblige, swinging either partially or fully open. This could simply look sloppy, or, if trying to move the chair around, cause the cup holder to bang into doorframes or catch on other objects.

5) When desiring the cup holder to stay in the open position, if the chair were on a slightly uneven surface, it may try to swing partially or fully closed. A cup holder that does not remain stationary in the open position may cause beverages to be in different positions relative to the chair arm or block the cup holder opening and thus prevent one from putting a beverage in the holder. The cup holder may also rotate slightly when a beverage is put into or taken out of the holder, when it would be preferable if the cup holder would just stay in one place.

6) It might be difficult to open the cup holder as one may have to bend their head over the side of the chair to see where the cup holder is, and even then, one might not know which end of the cup holder to pull out on.

7) When opening the cup holder, one might damage the cup holder if they pull it open too hard as there is no defined stopping point for the cup holder and it could be rotated beyond its intended open position to a point where components are stretched, cracked, or otherwise stressed and damaged. The same might occur if the cup holder were closed forcefully where it would be rotated beyond the closed position and damaged.

8) A screw gun or some other power tool would likely be necessary to perform the assembly of this type of cup holder in a timely manner. Power tools are expensive and can break. Plus assemblers may have difficulty using them or achieving just the right amount of torque on the bolt or screw to achieve a proper tightness. If the bolt or screw is too loose the cup holder may wobble, if too tight the cup holder may not rotate easily.

9) This type of cup holder may also prevent or impede stacking of the chair, as the cumulative height of the chair arm and the cup holder could be significant.

In summary, cup holders such as disclosed in U.S. Pat. Nos. 6,361,105 B1 and 8,182,031 B2 have a variety of weaknesses.

There is a need for a molded plastic chair having a cup holder which can be stacked one upon another for storage and shipment. Preferably the cup holder is retractable and will stay in either the storage position or the extended position after being placed in that position by the user. Preferably it will have sufficient structure to be able to withstand normal usage. Preferably there will be a robust connection between the cup holder and chair. Preferably there will be a break-away mechanism, such that if the cup holder were knocked off by accident, no components in the system (i.e. neither the chair arm, the connector holding the cup holder to the arm, nor the cup holder itself) would be damaged and preferably the cup holder could be reinstalled multiple times with no loss in functionality. Preferably the cup holder will have a no-look gripping tab; one that can be located by touch without having to look over the side of the chair arm. Preferably the cup holder will feature definite, sturdy stops for when it has reached either its fully opened or fully closed positions. Rough-handling users should not be able to damage the cup holder by swiveling it beyond its fully-open or fully-closed position, and the cup holder should, once closed, be aligned on its outer edge in parallel with the outside of the chair arm. Preferably the cup holder could be assembled quickly and easily either by hand or with a small mallet. The cup holder should be capable of holding cups, cans, mugs, tumblers, wine glasses and all commonly used types of beverage bottles from which people routinely drink. Preferably the cup holder is made of that same or similar plastic as the chair to which it is attached.

SUMMARY OF THE INVENTION

A stackable molded plastic chair is provided having a seat and a seat back attached to the rear edge of the seat, legs extending from the seat and a pair of arms. The bottom surface of the chair arm has a cylindrical boss. There is a recess in the interior surface of the boss at the uppermost portion of the boss. A cup holder is connected to the chair arm for movement between a retracted position lying underneath the chair arm and an open position extending away from the arm of the chair.

The cup holder has a body having a top surface, a bottom surface and an opening sized to receive a cup. There is a tubular boss having a first portion extending from the top surface of the body and a second portion extending from the bottom surface of the body. The first portion is at least partially within the cylindrical boss on the chair arm. Preferably the interior surface of the second portion of the tubular boss is tapered inward from an end of the second portion towards the first portion. The inside surface of the first portion of the tubular boss may or may not be tapered.

There is a pin within the tubular boss. The pin has a head and two or more spaced apart legs. Each leg has a first end attached to the head and a second end opposite the first end. A foot is attached to each leg. The pin is sized and configured for insertion into the tubular boss such that as the pin is inserted into the tubular boss the legs will move inward and then will move outward when the feet reach the recess. The feet are each sized and configured to fit into the recess. We prefer that the legs have an outward curvature. The use of multiple legs having an outward curvature allows the pin to pop free when an excessive force is applied to the cup holder releasing the cup holder from the chair arm without breaking either the cup holder or the chair arm or the pin.

Other objects and advantages of the present invention will become apparent from a description of certain presently preferred embodiments shown in the figures.

DETAILED DESCRIPTION OF THE PREFERRED EMBODIMENTS

Figure 1:
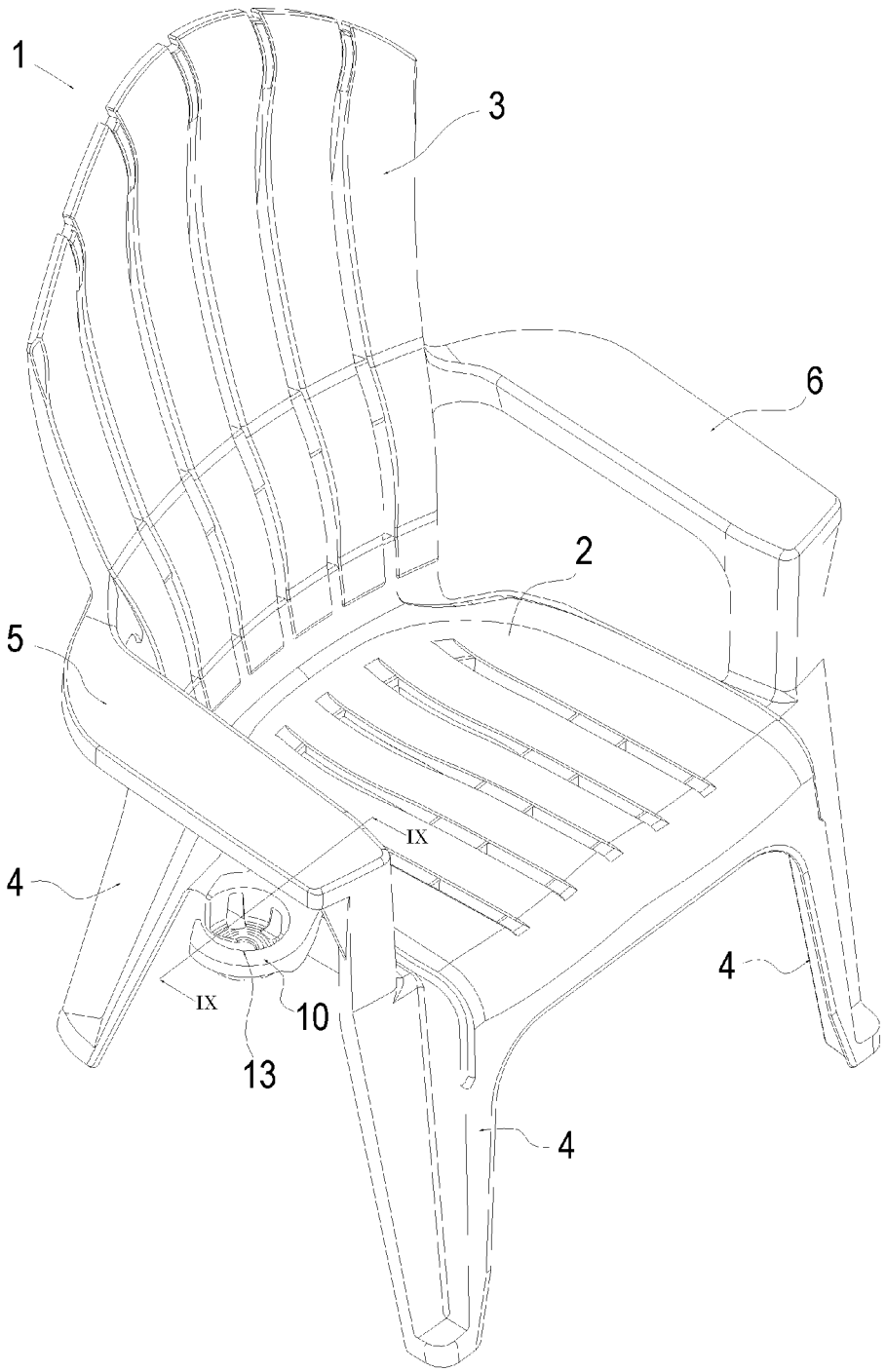
FIG. 1 is a front perspective view of a present preferred embodiment of our chair having a retractable cup holder with the cup holder in an extended position.
Figure 2:
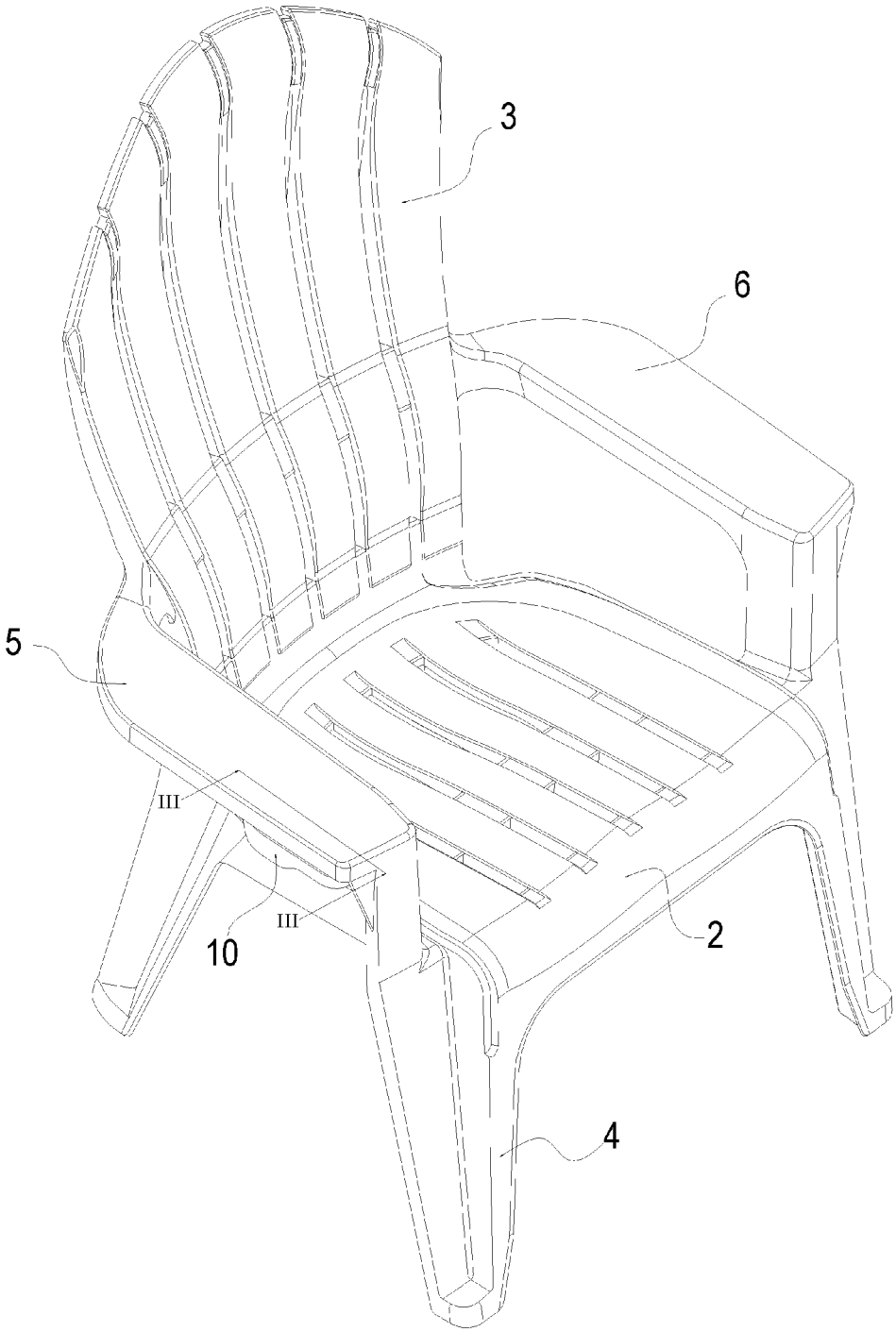
FIG. 2 is front perspective view similar to FIG. 1 with the cup holder in a retracted position.

As can be seen in FIGS. 1 and 2 we provide a chair 1 having a seat 2, back 3, legs 4, right arm 5 and left arm 6. In the chair shown in the drawings the arms 5, 6 are attached to both the seat 2 and the back 3. However, the arms could be attached to only the seat or could be attached only to the back. We further provide a cup holder 10 which is attached to one of the arms. In the drawings the chair 1 has one cup holder 10 attached to the right arm 5. However, the chair may have one cup holder attached to the left arm or two cup holders, one attached to each arm. The cup holder is attached to the underside of the arm in a manner which enables the cup holder to move between a storage position in which the cup holder is underneath the arm as shown in FIG. 2 and an extended position shown in FIG. 1.

Figure 3:
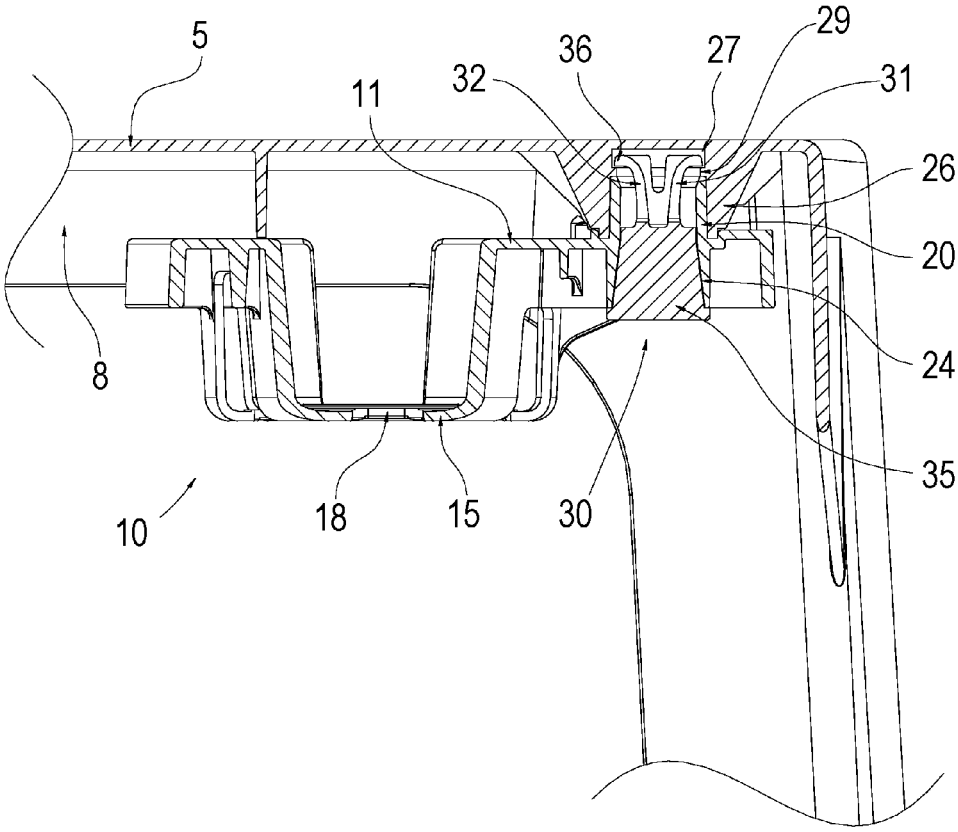
FIG. 3 is a sectional view taken along the line III-III in FIG. 2.
Figure 4:
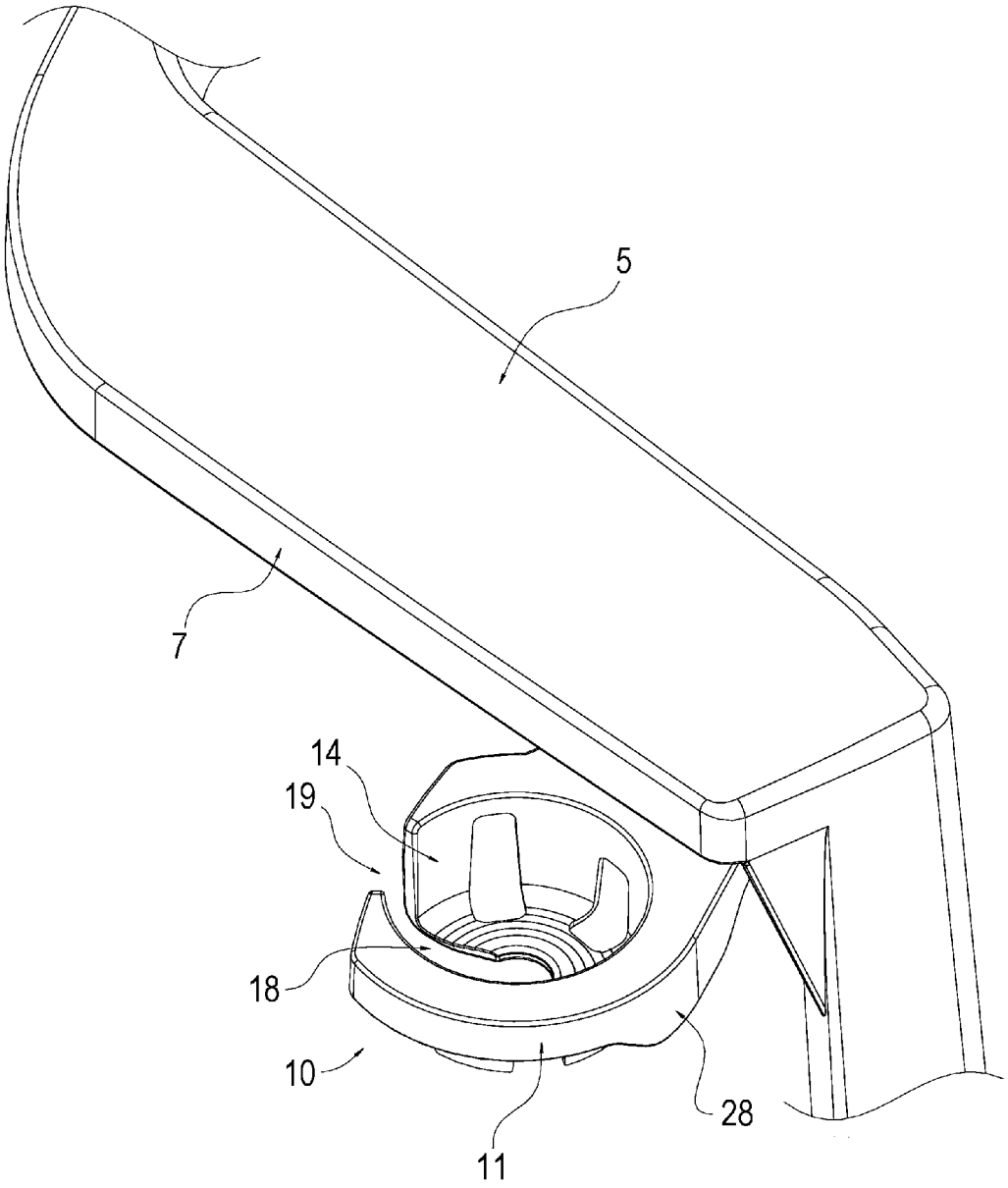
FIG. 4 is a top perspective view of a portion of the chair arm and the cup holder in an extended position.
Figure 6:
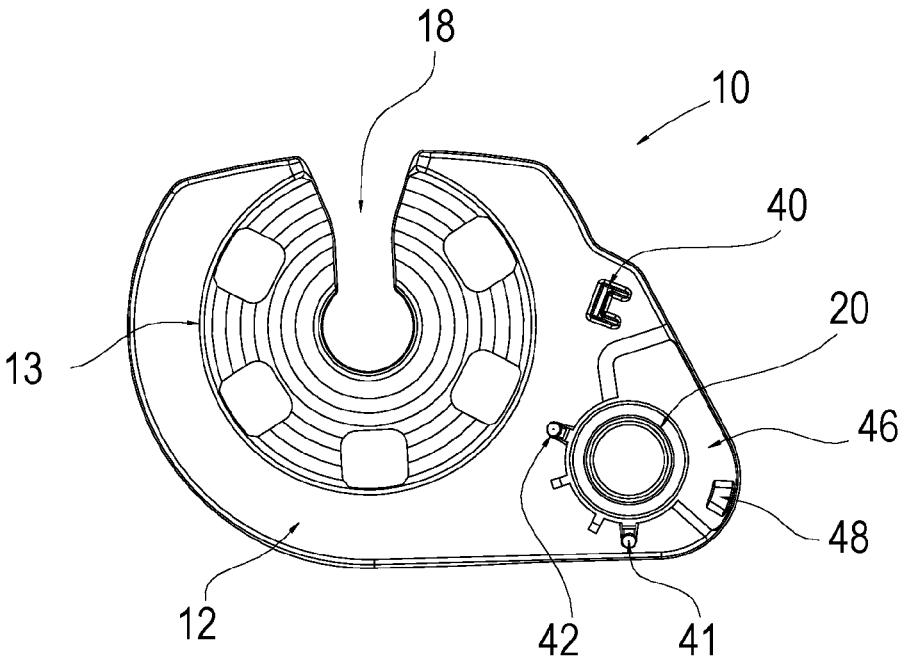
FIG. 6 is a top view of the cup holder shown in FIGS. 1 through 5.

The cup holder 10 has a body 11 with top surface 12 (see FIGS. 3 and 6). There is an opening 13 in the top surface which is sized to receive a cup, tumbler, can, or beverage bottle. In a present preferred embodiment the opening in the cup holder has a diameter of about 3.5 inches (8.9 cm.). The body 11 includes a generally cylindrical wall 14 that surrounds the opening 13 and extends to a base 15 on which a cup being held (not shown) can rest. We prefer to provide a slot 18 in the base 15 and an opening 19 in the side wall 14 and body 11 to enable the cup holder to securely hold a wine glass. The wine glass can be placed in the cup holder so that the stem of the glass extends through the slot 18.

Figure 5:
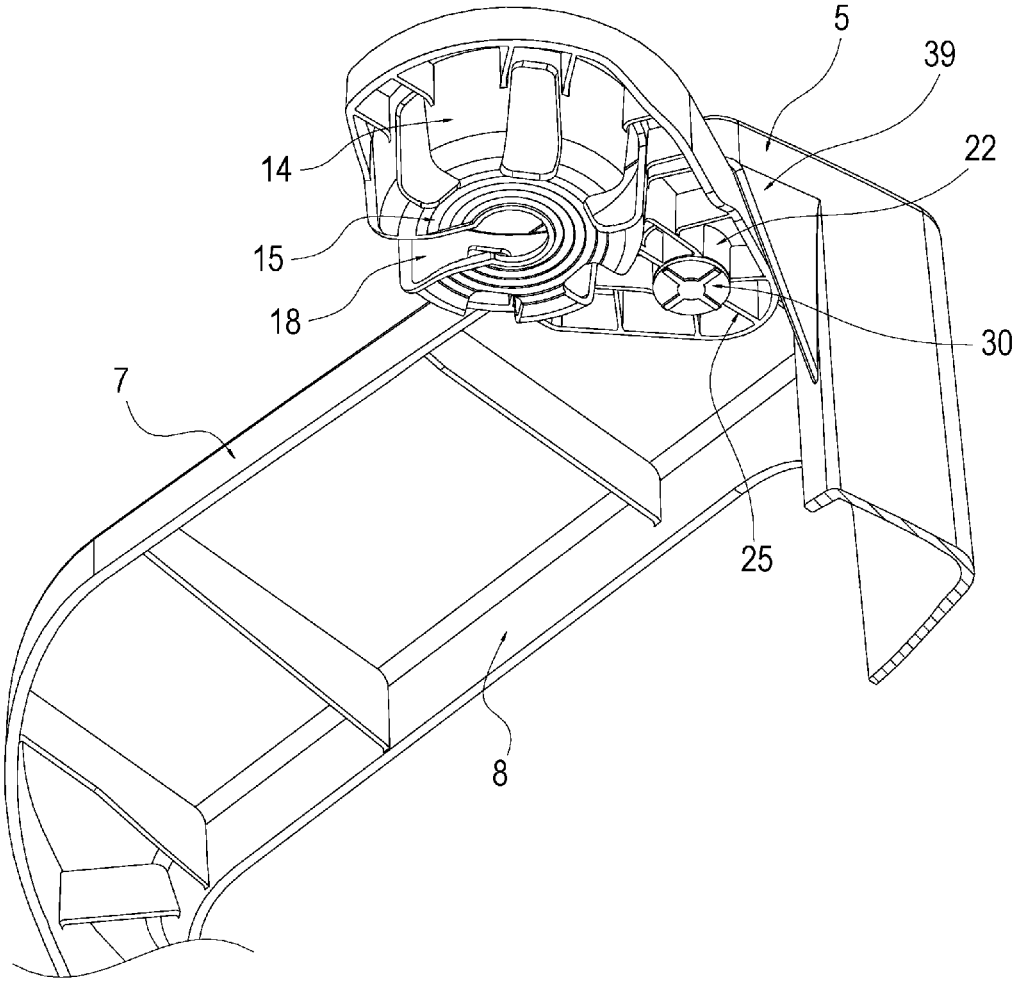
FIG. 5 is a bottom perspective view of a portion of the chair arm and the cup holder in an extended position.
Figure 13:
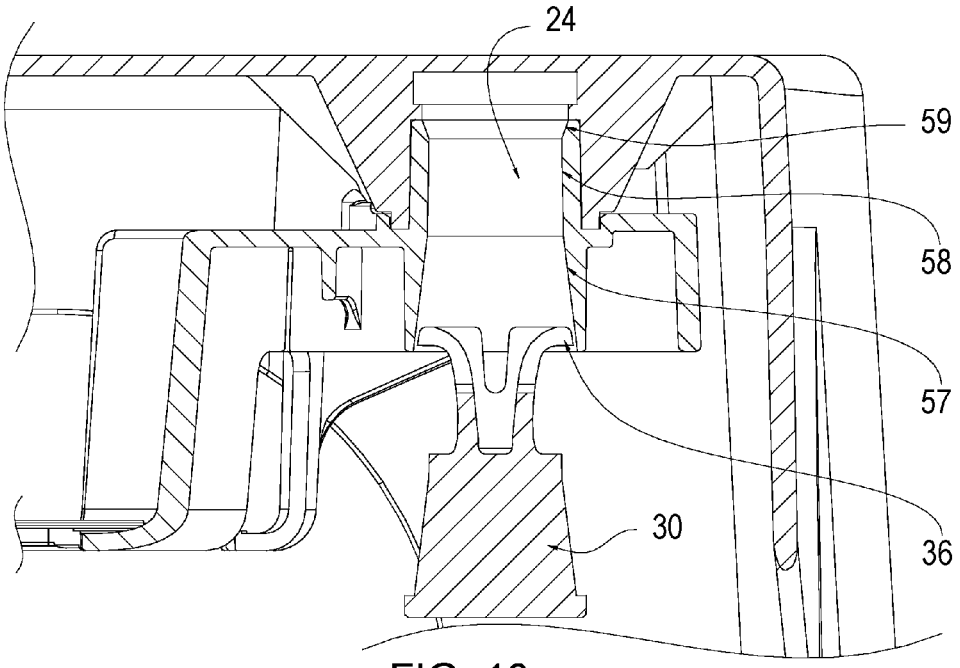
FIG. 13 is a portion of sectional view of FIG. 9 showing the pin as it begins to be inserted.

The body 11 of the cup holder 10 also has a tubular boss 20 having a first portion 21 that extends above the top surface 12 of the cup holder and a second, lower portion 22 that extends from the bottom surface of the cup holder 10. As can be seen most clearly in FIG. 3, the upper portion 21 of the tubular boss 20 is sized to fit within a cylindrical boss 26 on the underside of the chair arm. There is a continuous interior boss surface 24 that runs from the bottom of the lower portion to the top of the upper portion. Referring to FIG. 13, the interior boss surface 24, starting at its bottom edge, tapers inward for a portion 57, then is roughly vertical for a portion 58, and finally tapers outward for a short portion 59 as it approaches its top edge. We prefer to provide ribs 25 (see FIG. 5) on the second portion 22 of the tubular boss 20 for added strength. The cylindrical boss 26 on the underside of the chair arm has a recess 27 on the upper end of its inner surface with a ring 29 at the bottom of the recess which has a top surface that acts as a ledge 37. The ring is formed by a collapsible core mechanism in the mold. The upper portion 21 of the tubular boss 20 (see FIG. 9) is inserted into the cylindrical boss 26 in the chair arm. Preferably the upper end of the first portion of the tubular boss is at or slightly below the ring 29 in the cylindrical boss 26 on the underside of the chair arm. The cup holder is held on the chair arm by a pin 30 that is inserted through the boss 20 in the cup holder 10 into the cylindrical boss 26 on the chair arm.

Figure 7:
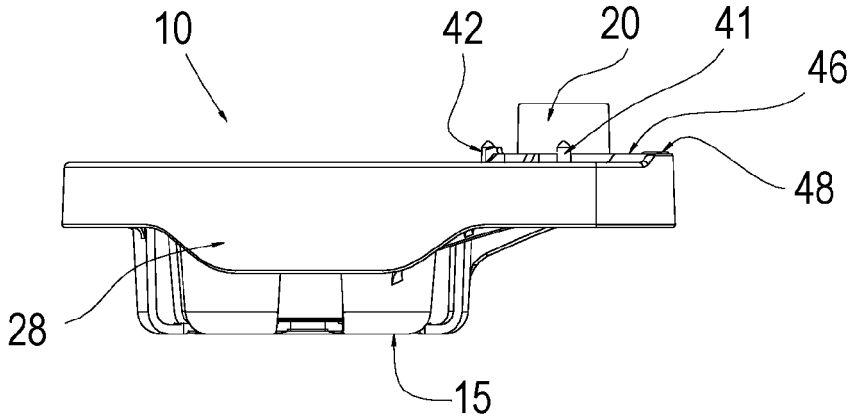
FIG. 7 is a side view of the cup holder shown in FIGS. 1 through 6.
Figure 8:
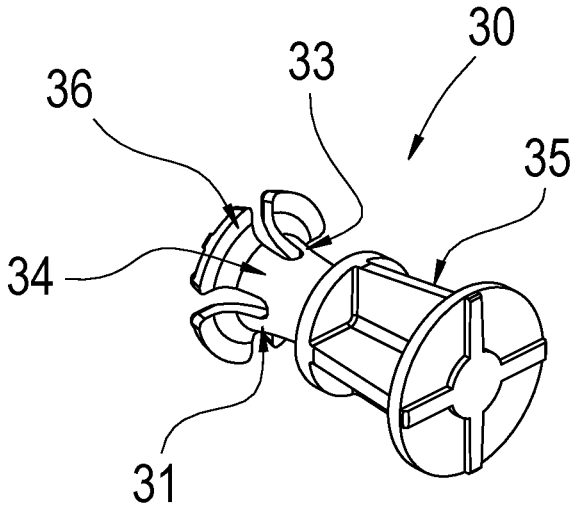
FIG. 8 is a perspective view of a present preferred pin which connects the cup holder to the chair arm.
Figure 14:
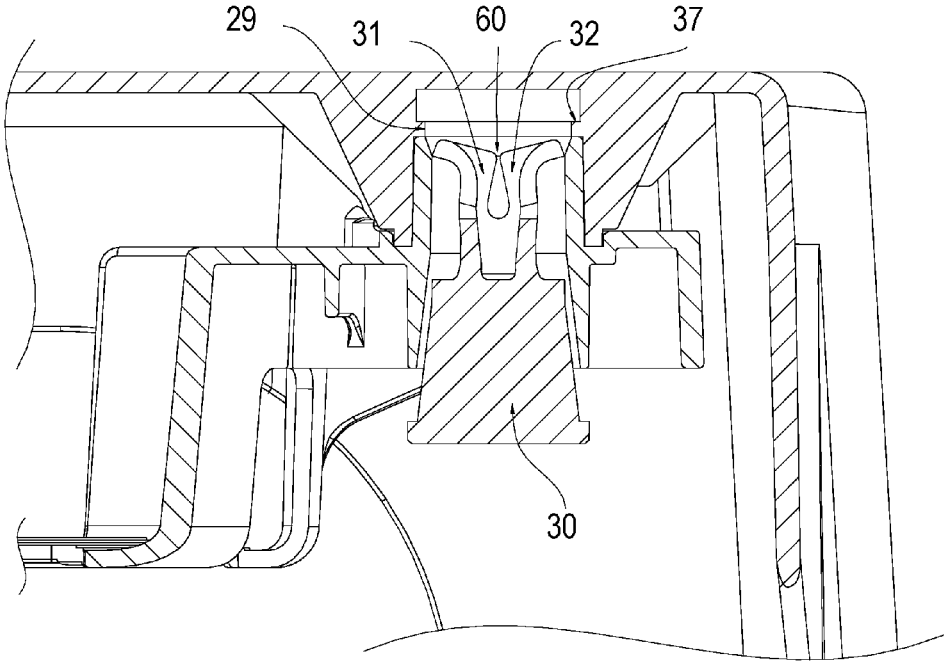
FIG. 14 is a section view similar to FIG. 13 showing the pin partially inserted.

A preferred pin 30 which can be seen most clearly in FIGS. 3 and 7 has four spaced apart legs 31, 32, 33, 34 that extend from a head 35. Each leg has projection or foot 36 on its distal end. There is a slot between each adjacent leg. The slots can be, but need not be the same depth. As shown in the pin shown in FIG. 8 preferably the slots are of equal length. The purpose of the tapered portion 57 is to expand the opening at the end of the second portion 22 to allow hand loading of the pin. As can be seen in FIGS. 13 and 14, as the pin 30 is inserted into the interior boss surface 24 of the cup holder boss 20, the taper inward causes the legs 31, 32, 33, 34 to move toward one another creating a narrower slot 60 between adjacent legs. The legs and feet 36 must compress enough to be able to pass through the narrowest diameter of the interior boss surface 24. When the pin 30 is fully inserted the feet 36 will have passed beyond the upper end of the tubular boss and past the ring 29. The legs 31, 32, 33, 34, as they reach the fully inserted position shown in FIG. 3, will move away from one another and the feet 36 will rest on the ledge 37 within the recess 27 in the interior surface of the chair arm boss 26 holding the cup holder 10 on the chair arm. The legs could be straight, but preferably the legs have an outward curvature to create slack such that under higher loadings the legs are able to straighten and release without the feet or ledge being broken off.

The preferred pin will have feet 36 of equal width and slots of equal width, with the slots being as narrow as possible while still allowing sufficient compression of the legs and feet for the pin 30 to be able to pass through the narrowest diameter of the interior boss surface 24. The legs 31, 32, 33, 34 will each be the same width, and the feet 36 will each be the same width. The benefit of the narrowest slots possible and equal-width legs and feet is the maximum possible engagement of the pin onto the ledge 37 and minimal variation in holding power no matter how the pin is rotated relative to the loading. As the pin orientation is random since it is not keyed into any position, this pin design creates the best holding consistency between any potential positions of the pin within its 360 degree potential rotation.

The cup holder shown in the drawings will hold in the ballpark of 7.5 pounds for an extended period of time depending upon the material from which the cup holder is made and the specific usage conditions. If a weight or downward force is applied to the top of the cup holder, the combination of multiple legs and the curvature of the legs allow the pin to pop free releasing the cup holder from the chair arm without breaking the cup holder, pin, or the chair arm. Then the cup holder can be reconnected to the chair arm by turning the chair over and inserting the cup holder boss into the chair arm boss 26, and pushing on the pin so that the feet 36 engage the ledge 37.

Figure 9:
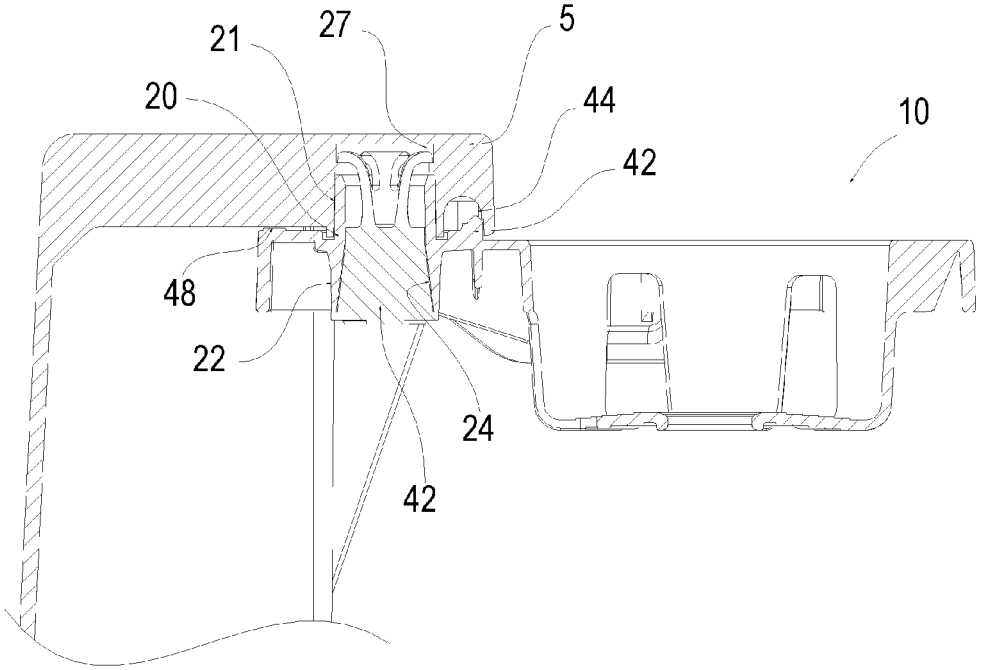
FIG. 9 is a sectional view taken along the line IX-IX in FIG. 1.
Figure 10:
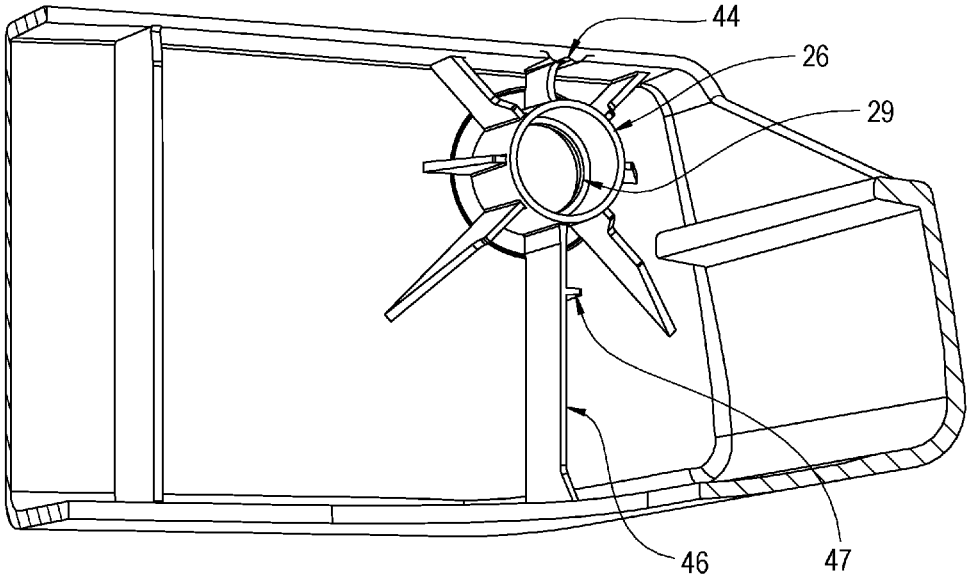
FIG. 10 is a bottom perspective view of a portion of the chair arm without the cup holder.

Referring to FIGS. 6, 7 and 9 we prefer to provide two nubs 41 and 42 on the top surface of the cup holder and a detent 44 on the chair arm. When the cup holder is in the retracted or storage position nub 41 will be in the detent 44. When the cup holder is in the extended position shown in FIG. 9, nub 42 will be in the detent 44. The nubs 41 and 42 are sized to lock the cup holder in either the extended position or the retracted position by means of the detent 44 (as shown in FIG. 10). As can be seen most clearly in FIG. 5 the chair arm has an outer wall 7 and an inner wall 8. We prefer that the inner wall be taller than the outer wall. A shorter outer wall permits a more compact attachment of the cup holder to the chair arm while the taller inner wall provides greater strength to the chair arm to offset the strength loss from having a shorter outer wall. A key element of a good cup holder is its depth from the top surface 12 to the base 15. The shortening of the outer wall in our preferred execution allows a 1.75" depth to provide excellent stability to drinks. We also prefer that a portion 28 of the outside wall of the cup holder 10 be taller than the inside wall. This taller portion creates a tab that the user could locate by touch and which also provides a larger gripping surface for moving the cup holder from a retracted position to the extended position.

We prefer to provide a stop 40 on the top surface 12 of the cup holder 10. This stop will engage the outer sidewall 7 of the chair arm 5 preventing the cup holder 10 from moving beyond a selected position as the cup holder 10 is moved from the retracted position shown in FIG. 1 to a fully extended position shown in FIG. 2. We also prefer that the cup holder be sized and positioned so that when the stop 40 hits the wall of the arm, the outer end of the cup holder hits an arm support 39 that extends form the seat and supports the front end of the arm.

As can be seen in FIGS. 6 and 7 the cup holder preferably has a raised landing or shelf 46 on the end that remains underneath the arm while the cup holder is in either the retracted position or the extended position, or is being moved in between the two. When the cup holder is in the extended position this shelf engages or is very close to a surface of the underside of the arm. There is a bump 48 on the shelf 46 which hits the arm rib when a load is placed on the cup holder creating a pivot point. The location at which the shelf hits the chair arm rib becomes the pivot point when a load is applied to the exposed portion of the cup holder while the cup holder is in the extended position. As the pivot point would be exposed to compression during loading, a structural element such as the support rib 47 as shown in FIG. 10 has been added to provide stiffness to the main rib 46 such that it would not buckle. In place of a support rib 47, the main rib may just be thickening at that location to create extra stiffness at the pivot point. Without this shelf the pivot point would be at the boss 20 of the cup holder. We ran a computer-simulated test of a cup holder without the shelf and a second cup holder having the shelf as shown in FIGS. 6 and 7. A load was applied to the cup holder without a shelf sufficient to cause the cup holder to release from the arm. The simulation showed that the legs of the pin facing towards the load got almost all of the stress, and that the pin and the ledge onto which the feet of the pin grip would undergo many times the stress the material used would be able to withstand without being severely distorted or cracked. However, in the pin that held the cup holder with the shelf the legs were able to share the load more evenly and with tolerable stress levels. As a result the pin and ledge would not be damaged and the cup holder could be reattached to the chair arm. Although the cup holder without the shelf actually held more weight before releasing, the failure was destructive. Even though the cup holder with the shelf held less, it was still plenty strong for its intended purpose and provided the advantage of failing non-destructively.

We real-world tested three chairs with cup holders like the chair shown in the drawings. We placed a weight of five pound in the cup holder then opened and closed the cup holder 100 times with the weight in the cup holder. Then we allowed the weight to remain in the cup holder with the cup holder in the extended position. After 12 hours the cup holder was still connected to the arm of the chair. Then we repeated the test using weights of 7.5 pounds, 10 pounds and 15 pounds. The cup holder containing the 7.5 pounds weight was still connected to the chair after 12 hours. The cup holder containing the 10 pounds weight released from the arm of the chair after 33 minutes. The cup holder containing the 15 pounds weight released from the arm of the chair after 3 minutes and 39 seconds. None of the cup holders that released from the chair were damaged and could be reattached to the chair using the original pin.

The chair and the cup holder are preferably an injected molded plastic product. The plastic may be polypropylene, polyvinylchloride polycarbonate, ABS or other suitable plastic. If desired, the plastic may also be reinforced with fiberglass or filled with other materials commonly used in the industry. The pin can be made of a harder plastic than the plastic used to make the chair and the cup holder. If the pin is a harder material than the chair, then the feet can be configured to embed into the inner wall of the boss that extends from the underside of the chair arm. Lexan and polycarbonate are suitable plastics for the pin. In a preferred embodiment of our chair, the cup holder and the chair are made from polypropylene and the pin is polycarbonate.

Figure 11:
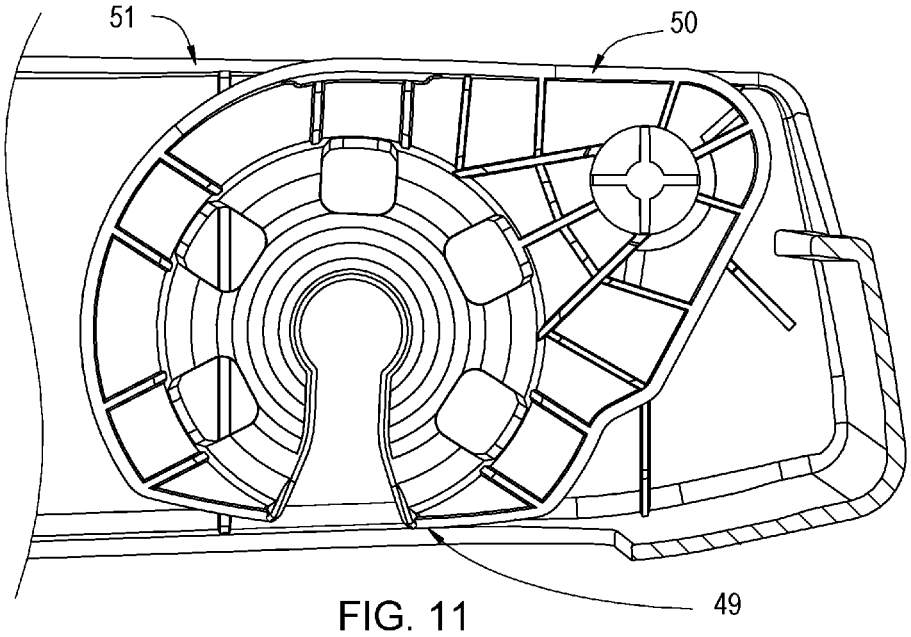
FIG. 11 is a bottom view of a portion of the chair arm with the cup holder in its retracted position.

FIG. 11 shows how cup holder is designed to hit and utilize the inside wall 49 of the arm as a definite stop for when the cup holder is being pushed into the closed position, with the outer sidewall 50 of the cup holder lying directly underneath the outer sidewall 51 of the arm.

Figure 12:
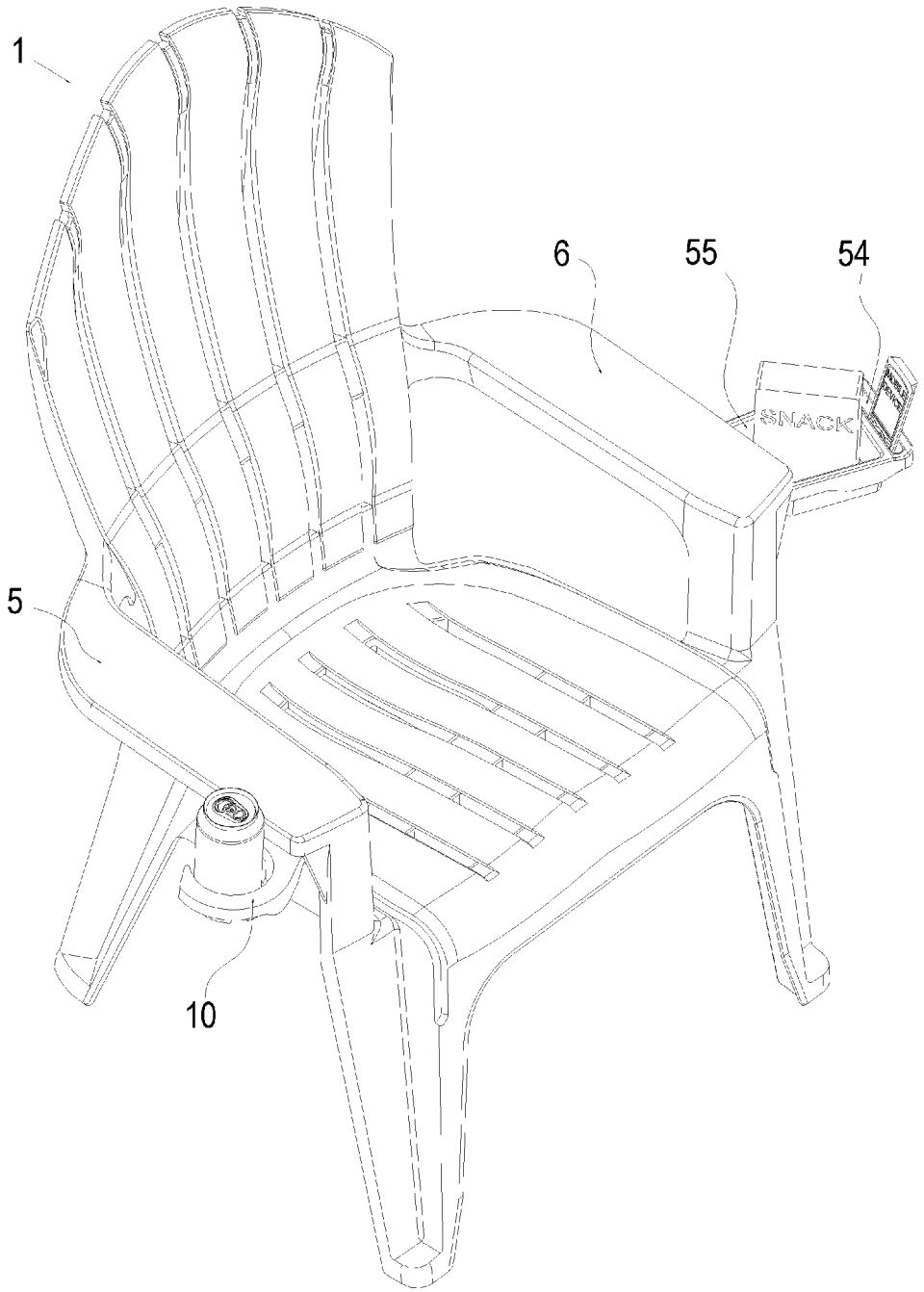
FIG. 12 is a front perspective view similar to FIG. 1 showing a cup holder in use and a snack/phone holder in use on the other arm.

FIG. 12 illustrates how the general concept of the cup holder could be implemented to create other types of holders or other swiveling accessories. A slot 54 as shown could be used to hold a mobile phone or other technological device and a cavity or bin 55 could be used to hold snacks such as a box of candy, popcorn, chips, or Cracker Jacks. The bin could also be used to hold a bottle or tube of suntan lotion, sunglasses, keys, a wallet, magazines, a book, or various other items. The article holder could have a hole to receiving and holding an umbrella. The article holder could be attached to either arm. The article holder could be on a chair as the only swing-out holder featured, or one could be used on the left arm with the cup holder on the right arm, or in any combination of configurations. They could rotate off of a rear swivel as well as off of the forward swivel depending on the ideal positioning of the holder for its intended application. For example, an umbrella holder might be better positioned further back on the arm so an umbrella holder might swing rearward to be moved into its open position.

Although we have shown and described certain present preferred embodiments of our chair having a retractable cup holder our invention is not limited thereto but may be variously embodied within the scope of the following claims.

We claim:

1. A chair comprising:

a seat;

a back attached to the seat;

legs attached to the seat;

a chair arm attached to at least one of the seat and the back, the chair arm having a bottom surface and a cylindrical boss, the cylindrical boss having a first end attached to the bottom surface, a second end opposite the first end and an interior surface, the interior surface having a recess adjacent the first end;

a cup holder connected to the chair arm for movement between a retracted position lying underneath the chair arm and an extended position in which a portion of the cup holder extends away from the chair arm, the cup holder comprised of:

a body having an opening sized to receive a cup, a top surface and a bottom surface; and a tubular boss having a first portion extending from the top surface of the body and a second portion extending from the bottom surface of the body, the first portion being at least partially within the cylindrical boss on the chair arm; and a pin within the tubular boss, the pin comprised of head and a plurality of spaced apart legs, each leg having a first end attached to the head and a second end opposite the first end, and a foot attached to each leg, the pin being sized and configured for insertion into the tubular boss such that as the pin is inserted into the tubular boss the legs will move inward and then will move outward when the feet reach the recess, each foot sized and configured to fit into the recess.

2. The chair of claim 1 wherein the chair arm has a detent further comprising a first nub on the top surface of the body of the cup holder and a second nub on the top surface of the cup holder, the first nub being sized and positioned to be in the detent when the cup holder is in a retracted position, and the second nub being sized and positioned to be in the detent when the cup holder is in an extended position.

3. The chair of claim 1 also comprising a shelf on the top surface of the cup holder, the shelf sized and positioned to engage the bottom surface of the chair arm and become the pivot point for the cup holder when the cup holder is in an extended position and a load is applied to the cup holder.

4. The chair of claim 1 wherein the plurality of spaced apart legs have a curved outer surface.

5. The chair of claim 1 wherein the plurality of spaced apart legs have a straight outer surface.

6. The chair of claim 1 wherein the pin has four legs.

7. The chair of claim 1 wherein each leg and foot on the pin is of equal width and each slot is of equal width with the slots being at or near a minimal width necessary to allow the feet to compress sufficiently to pass through the interior surface of the tubular cup holder boss at its narrowest point.

8. The chair of claim 1 wherein the chair is molded of a plastic selected from the group consisting of polypropylene, polyvinyl chloride, polycarbonate and ABS.

9. The chair of claim 1 wherein the chair is polypropylene and the pin is polycarbonate.

10. The chair of claim 1 wherein the arm has a detent on an outer sidewall to receive a nub on the cup holder when the cup holder is in the open position and to receive a second nub when the cup holder is in the retracted position.

11. The chair of claim 1 also comprising an inside wall on the chair arm, the inside wall positioned so that the cup holder impacts the inside wall of the arm as it is being pushed into and reaches its retracted position.

12. The chair of claim 1 wherein the chair arm has an outer sidewall extending from the underside of the chair arm, the sidewall positioned such that the cup holder passes under the sidewall as the cup holder is moved between a retracted position and an open position and an inner sidewall opposite the outer sidewall wherein the inner sidewall is taller than the outer sidewall.

13. The chair of claim 1 also comprising a plurality of ribs attached to the tubular boss.

14. The chair of claim 1 also comprising a plurality of ribs attached to the second portion of the tubular boss.

15. The cup holder boss of claim 1 wherein the tubular boss has a bottom end diameter wider than a diameter of the feet of the pin.

16. The chair of claim 1 wherein the tubular boss has an interior surface, at least a portion of the interior surface within the second portion of the tubular boss being tapered inward from an end of the second portion towards the first portion.

17. The chair of claim 16 wherein at least a portion of the interior surface of the tubular boss that is within the first portion of the tubular boss is substantially vertical for a portion and tapers outward approaching an upper end of the first portion.

18. The chair of claim 1 wherein the chair arm has an outer sidewall extending from the underside of the chair arm, the sidewall positioned such that the cup holder passes under the sidewall as the cup holder is moved between a retracted position and an open position and also comprising a stop on the top surface of the cup holder, the stop sized and positioned to stop movement of the cup holder away from the underside of the arm when the cup holder reaches the extended position.

19. The chair of claim 18 also comprising an arm support extending between the seat and the chair arm, wherein the cup holder is sized and positioned so that when the stop engages the chair arm the cup holder will hit the arm support.

20. A chair comprising:

a seat;

a back attached to the seat;

legs attached to the seat;

a chair arm attached to at least one of the seat and the back, the chair arm having a bottom surface and a cylindrical boss, the cylindrical boss having a first end attached to the bottom surface, a second end opposite the first end and an interior surface, the interior surface having a recess adjacent the first end;

an article holder connected to the chair arm for movement between a retracted position lying underneath the chair arm and an extended position in which a portion of the article holder extends away from the chair arm, the article holder comprised of:

a body having a top surface, a bottom surface and at least one cavity sized to receive at least one of a snack container, a container of suntan lotion, sunglasses, keys, a wallet, a book, a magazine and a mobile phone; and a tubular boss having a first portion extending from the top surface of the body and a second portion extending from the bottom surface of the body, the first portion being at least partially within the cylindrical boss on the chair arm; and a pin within the tubular boss, the pin comprised of head and a plurality of spaced apart legs, each leg having a first end attached to the head and a second end opposite the first end, and a foot attached to each leg, the pin being sized and configured for insertion into the tubular boss such that as the pin is inserted into the tubular boss the legs will move inward and then will move outward when the feet reach the recess, each foot sized and configured to fit into the recess.

* * * * *